US005607553A

United States Patent [19]

Chadha

[11] Patent Number: 5,607,553

[45] Date of Patent: Mar. 4, 1997

[54] METHOD AND APPARATUS FOR FINISHING PAPER

[75] Inventor: D. Deepak Chadha, Columbia, Md.

[73] Assignee: Westvaco Corporation, New York, N.Y.

[21] Appl. No.: 520,411

[22] Filed: Aug. 29, 1995

[51] Int. Cl.[6] ..... D21F 11/00; D21G 1/00; B30B 15/34

[52] U.S. Cl. ..... 162/205; 162/206; 162/361; 427/209; 100/38

[58] Field of Search ..... 162/205, 206, 162/207, 361; 427/209, 210, 211; 100/38, 93 RP; 239/121, 220, 288

[56] References Cited

U.S. PATENT DOCUMENTS

| | | | |
|---|---|---|---|
| 1,864,852 | 6/1932 | Oblinger | 162/206 |
| 2,069,063 | 1/1937 | Gibbs | 154/2 |
| 2,130,530 | 9/1938 | Fletcher | 91/70 |
| 2,251,890 | 8/1941 | Montgomery | 162/206 |
| 2,478,230 | 8/1949 | Bouvet | 28/182 |
| 3,024,129 | 3/1962 | Brundige | 427/364 |
| 4,670,102 | 6/1987 | Maurer | 162/361 |
| 4,671,173 | 6/1987 | Boissevain | 100/38 |
| 4,786,529 | 11/1988 | Boissevain | 427/296 |
| 4,973,441 | 11/1990 | Keller | 264/280 |
| 5,163,365 | 11/1992 | Taylor | 100/38 |
| 5,246,546 | 9/1993 | Ampulski | 162/112 |
| 5,314,119 | 5/1994 | Watt | 239/220 |

*Primary Examiner*—Donald E. Czaja
*Assistant Examiner*—Jose A. Fortuna

[57] ABSTRACT

A method is disclosed for finishing a web of paper, paperboard or the like to achieve enhanced stiffness with a minimal loss of caliper or bulk. For this purpose, liquid spray devices are substituted for the conventional waterboxes of a machine calender. These devices permit the independent control of the thickness of liquid films applied to the transfer rolls of the calender with greater uniformity. The liquid films are transferred to the surfaces of the web at transfer nips. The method produces an I-beam effect in the web with highly densified and smooth surface layers and a bulky interior to maximize stiffness.

2 Claims, 1 Drawing Sheet

METHOD AND APPARATUS FOR FINISHING PAPER

BACKGROUND OF INVENTION

The present invention relates generally to the finishing of paper and paperboard, and more particularly to an improvement in a conventional waterbox calender for finishing paperboard to provide enhanced stiffness with a minimal loss of caliper or bulk.

It is common practice in the paper industry to add moisture to a paper web at the machine calender during the papermaking process. Although other methods of moisture application have been proposed, it is most commonly carried out by waterbox calendering. A typical example of a conventional waterbox calender is disclosed for instance in U.S. Pat. No. 2,130,530 to Fletcher. However, an inherent problem with the use of a waterbox calender is a lack of control of the amount of liquid picked up by the web in the calender nip. During conventional waterbox calendering, the amount of liquid supplied to the calender nip is such that the nip is flooded. Thus the quantity of liquid picked up by the web is determined by the calender roll diameter, operating speed, calender nip pressure, and web characteristics (thickness, sizing level, and roughness). Accordingly the amount of moisture applied to a web using a waterbox calender cannot be controlled independently of the operating characteristics of the calender which are selected to achieve the desired paper or paperboard properties. For example, a typical papermachine is used to make a range of paper thicknesses or basis weights. However, if the operating characteristics of the waterbox calender are selected to give the desired paper properties for a specific basis weight, those operating characteristics may not be appropriate for other basis weight products. This is a decided disadvantage, since it is known that the stiffness of a paper web is determined by the densification of the fibers during calendering, which is related to the moisture content of the web at the time of calendering. In this regard, it is also known that increasing the density of a substantially homogeneous structure such as paper or paperboard during calendering, particularly with waterbox calendering, will, in general decrease stiffness. On the other hand, stiffness may be enhanced where the densification is controlled, as for example, with composite structures, where the outer layers can be made dense to have a higher elastic moduli than the center layer to achieve the so called I-beam effect. Thus it would be desirable to provide for a typical papermachine a more versatile method for adding moisture to the web prior to machine calendering to achieve an I-beam effect, than is presently possible using a conventional waterbox.

Other methods for adding moisture to a paper web include the application of steam or the use of water sprays. Application of steam to a web to increase its moisture content is possible, but it requires that the web be cooled for efficient condensation of the steam. Moreover, in addition to the equipment required for cooling the web, it is difficult to condense the quantity of steam required to impart the same smoothness that can be achieved by waterbox calendering. Spraying liquid directly onto a web is another method for increasing the moisture content of the web. However, conventional spraying systems which apply moisture directly to the web lack the uniformity required to produce a smooth surface. In addition, the lack of cross direction uniformity, and the production of wet streaks caused by the overlap of sprays from adjacent nozzles, results in nonuniform smoothness and caliper profiles. A third method for adding moisture to a web is to apply the liquid directly to the web using an offset roll or the like. An example of this method is shown in U.S. Pat. No. 4,973,441, wherein an apparatus is disclosed for offsetting a liquid or a plasticizer directly to a web before calendering to achieve a compressibility gradient in the web. However, this method like the use of steam, requires the addition of equipment to the papermachine prior to the machine calender, and in practice such offsetting devices have been found to be unsatisfactory for achieving a uniform cross direction moisture profile in the web.

Thus while the use of a waterbox calender is generally agreed to be the preferred method for adding moisture to a paper web, the problems inherent with conventional waterbox calendering have yet to be solved. Furthermore, the other conventional methods known for the application of moisture to webs have thus far been inefficient. Nevertheless, it would be advantageous to create within a substantially homogeneous structure such as paper or paperboard, the same structural characteristic (i.e., I-beam effect), that may be achieved in a composite structure with outer densified layers and a bulky interior. The objective, then, is to apply a minimum amount of moisture uniformly across the web so that upon calendering, only the outer layers of the web are densified (like a composite structure), to achieve enhanced stiffness. This result is accomplished with the practice of the present invention wherein the means for applying moisture to the web is of a novel type, specifically, a brush spray device capable of generating a mist of moisture, particularly as disclosed in U.S. Pat. No. 5,314,119, the volume of which can be controlled independently of the operating characteristics of the calender. Accordingly, the novelty of the present invention lies in the replacement of the waterboxes typically used on a machine calender with the brush spray devices more fully described hereinafter to achieve the desired results.

SUMMARY OF INVENTION

Modifying an existing waterbox calender to include a brush spray device as disclosed herein, provides a means for controlling the quantity of liquid applied to the surface of a substrate, notwithstanding the calender roll diameter, operating speed, calender nip pressure or the substrate characteristics, to achieve a final product having enhanced stiffness while retaining bulk. By substituting brush spray devices for the waterboxes adjacent to the transfer rolls of a machine calender, a minimum amount of moisture may be applied to one or both sides of the web, which upon pressing in the calender device, produces a web having thin densified surface layers and a bulky interior for enhanced stiffness. In this manner, no more than the amount of liquid required to achieve the desired smoothness is applied to the web. This method reduces the occurrence of web breaks that might result from the uncontrolled moisture application from a conventional waterbox, and also permits the manufacture of a greater range of basis weight products than would normally be possible with a conventional waterbox calender. Thus it is possible with the present invention to control the location and depth of penetration of the moisture into the substrate, and thereby reduce caliper losses during calendering, while still achieving a product having the desired smoothness with enhanced stiffness.

The present invention may be used in the manufacture of bleached or unbleached paper and paperboard, and particularly for those grades which have a high stiffness specification. Higher stiffness grades prepared by the present invention offer the further opportunity for the papermaker to reduce the fiber content of the web, and thereby reduce costs. Paperboard for use in the manufacture of cartons, and both cover and label grades of paper, are products which may benefit from the practice of the present invention.

DETAILED DESCRIPTION

Figure 1:
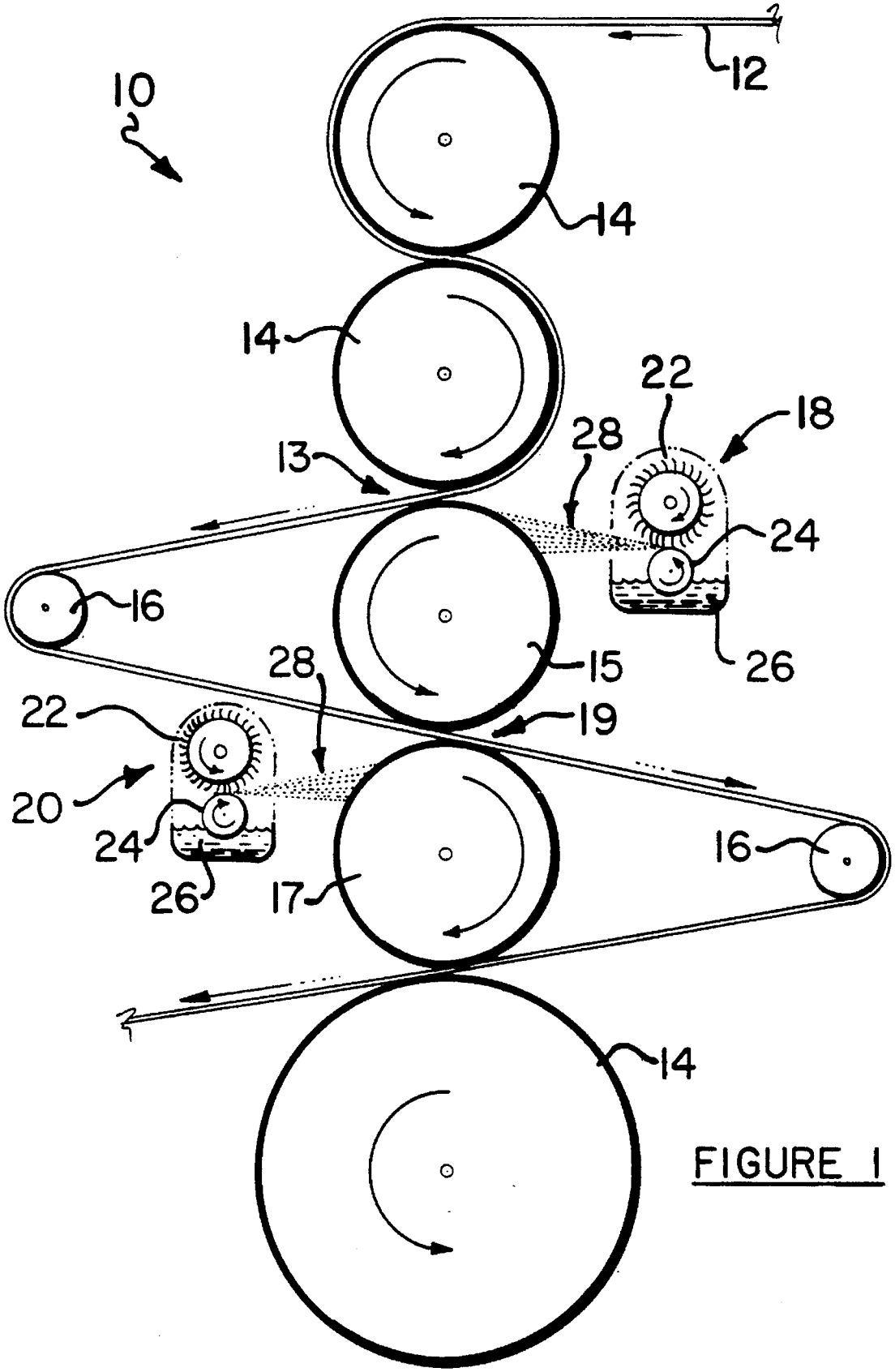
FIG. 1 shows an example of an apparatus useful for the present invention.

The following description is of the best presently contemplated mode of carrying out the invention. This description is made for the purpose of illustrating the general principles of the invention and should not be taken in a limiting sense. The breadth of the invention is limited only by the scope of the appended claims.

The present invention may be practiced with a typical calender device having a plurality of nipped rolls arranged in a single stack, of the type previously used in waterbox calendering of paper and paperboard webs, or the invention may be practiced with other so-called non-conventional calender devices as for example as shown in U.S. Pat. No. 4,670,102, owned by the present assignee herein. Notwithstanding the calender configuration, the essence of the present invention involves the use of a moisture application device of the brush spray type instead of the typical waterbox used in the past. An example of a brush spray device that may be used for the present invention is manufactured by Latanick Equipment, Inc. and is disclosed in more detail in U.S. Pat. No. 5,314,119, entitled: "Method and Apparatus for Applying Thin Coatings of Fluid Droplets", the disclosure of which is incorporated herein by reference. Other brush spray devices are known in the art, as for example, as shown in U.S. Pat. No. 2,069,063. However, in both the Latanick design and the design shown in the '063 patent, moisture is applied directly to the substrate web. When so applied, it is difficult to achieve a uniform moisture profile particularly across the width of the web. Thus, in contrast to these known application methods, the brush spray devices employed in the present invention are arranged to apply moisture to the transfer rolls of a calender device for transfer to the web at transfer nips. In operation, the brush spray devices employed herein operate independently of the calender device so that the amount of moisture applied to the transfer rolls can be controlled independently of the operating characteristics of the machine calender. Accordingly the cross direction uniformity can be controlled while still applying only a thin film of moisture to the web. In operation, it has been found that very little "bounce back" effect is produced with the brush spray design so that virtually all of the mist created by the rotating brush is applied to the web, in contrast to the typical operation of spray nozzles.

The use of a brush spray device in the present invention, driven independently of the calender device, provides the capability of reproducibly applying a minimum amount of moisture uniformly to one or both sides of a web of paper or the like. By applying the moisture to the transfer rolls of the calender device rather than the paper surface, it is possible to achieve the thin, densified surface layers desired for enhanced stiffness during calendering, notwithstanding the operating speed of the calender, or the thickness of the web, (i.e., the I-beam effect).

FIG. 1 shows an example of an apparatus useful for the present invention. A typical machine calender device 10 suitable for pressing a web of calenderable material, such as paper 12, includes a plurality of hard steel rolls 14, arranged in a vertical stack, wherein the paper web 12 passes between the calender rolls in a path of a general "S" configuration. Idler rolls 16 may be provided on each side of the stack to facilitate the wrinkle-free movement of the paper. In addition, the drawing illustrates a pair of brush spray devices 18 and 20, one arranged on each side of the calender stack, for the purpose of applying moisture to the web. Each of the brush spray devices includes a brush 22, a liquid metering roll 24 and a pan 26 of liquid. Rotation of the brush 22 against the metering roll 24 produces a liquid mist 28. The liquid mist is deposited in small droplets directly onto the transfer rolls 15 and 17 of the calender stack, at around the 2 O'clock and 10 O'clock positions. Transfer rolls 15 and 17 are the same rolls that would normally include waterbox devices for waterbox calendering. Each roll 15 and 17, carries a thin film of water or other liquid, directly into the respective transfer nips 13 and 19, where the liquid is transferred to the paper web 12. The amount of liquid applied to the transfer rolls 15, 17 may be varied by adjusting the speed of either the metering rolls 24 or the brush rolls 22 independently of the operating speed of the calender so as to apply the desired amount of moisture only to the surface or surfaces of the web.

In operation, the amount of moisture delivered to the transfer rolls 15, 17 by the brush spray devices 18, 20 is preferably increased in small increments until a micro-flooded nip is created. During preliminary trials, it was unexpectedly discovered that micro-flooding could be controlled to provide a uniform application of moisture only to the surface of the web 12, to achieve the desired I-beam effect of a very thin, densified layer at one or both surfaces of the web during machine calendering, with a larger, bulky interior to maximize stiffness. The results of the trial are reported in the following Example.

EXAMPLE

A brush spray unit from Latanick Equipment, Inc., was installed adjacent to a steel roll machine calender for finishing one side of a paperboard web. A conventional waterbox mix was applied to the web using the brush spray unit in two pound per ream increments (ream size 3000 sq. ft.), from 0 to 10 lb/ream. Calender loading was kept constant at 400 pli and the calender was operated at about 710 fpm. At an application level of about 6.6 lb/ream, micro-flooding was noted at the fluid transfer nip. Data from this trial were compared with the data from a conventional waterbox treated control. The results are shown in the following Table.

TABLE

| Water Applied lb/ream | Caliper pt. | Taber Stiffness MD/CD |
|---|---|---|
| 0 | 15.7 | 144/79.7 |
| 2.0 | 15.8 | 150/79.3 |
| 4.1 | 15.4 | 150/76.9 |
| 6.6 | 15.3 | 142/74.5 |
| 8.3 | 15.2 | 141/73.6 |
| 9.9 | 15.4 | 146/77.6 |
| Waterbox (Control) | 14.3 | 121/62.5 |

From the data in the Table, it will be seen that the trial conditions using the brush spray device of the present invention had at least 20% higher CD (cross direction) Taber Stiffness, without any appreciable reduction in bulk (caliper), as compared with the waterbox treated control which also lost about one point of caliper. In summary, these results demonstrated the enhanced stiffness that can be achieved with reduced water application during machine calendering using the brush spray device disclosed, while retaining a substantial portion of the bulk of the web. Moreover as compared with conventional waterbox calendering, the smaller flooded nip (micro-flooded), and lower moisture application rates obtained with the brush spray device, should contribute to better production by reducing the potential for web breaks. Further, by decoupling the means for applying moisture to the web from the means for driving the calender, it is possible to achieve the most desirable density distribution within the web notwithstanding the thickness of the web.

In summary, the present invention comprises a method and apparatus for finishing a web of paper, paperboard or the like by controlling the application of moisture to the web so as to apply a minimum level of moisture uniformly across the surface of the width of the web independently of the speed of the calender. The process provides a density gradient in the web to achieve an I-beam effect with a highly densified surface or surfaces and a bulky interior. The result is a web that has enhanced stiffness and bulk retention. While only one embodiment of the invention has been fully disclosed and described, it will be understood by those skilled in the art that various additional modifications may be made without departing from the spirit and scope of the invention as defined in the appended claims.

What is claimed is:

1. A method of finishing a web of paper to achieve enhanced stiffness and a highly densified and smooth surface layer with a minimal loss of bulk comprising the steps of:

(a) directing a paper web to a machine calender device comprising a plurality of hard steel rolls in nipped relation, at least one of which is a transfer roll to form a transfer nip;

(b) providing at least one brush spray device, which operates independently of the calender device for generating a mist of liquid moisture in the form of droplets at a rate that is independent of the speed of the machine calender device at a location adjacent and in close proximity to the transfer roll of the machine calender device;

(c) depositing a substantially uniform mist of liquid moisture from step (b) onto the transfer roll in a substantially uniform manner and in a minimal amount;

(d) transferring from about 2–10 lbs/ream (ream size 3000 $ft^2$) of liquid moisture from the transfer roll to one surface of the paper web in the transfer nip so that only the surface of the paper web is moistened; and, (e) calendering the web treated according to step (d) in one or more nips of the machine calender device including the transfer nip, to produce a thin densified layer at the treated surface of the web while substantially retaining the original bulk of the web.

2. The method of claim 1 comprising the following additional steps of:

(f) providing a second brush spray device on the opposite side of the machine calender device from the first brush spray device which operates independently of the calender device for generating a mist of liquid moisture in the form of droplets at a rate that is independent of the speed of the machine calender device at a location adjacent and in close proximity to a second transfer roll, (g) depositing a substantially uniform mist of liquid moisture from step (f) onto the second transfer roll in a substantially uniform manner and in a minimal amount;

(h) transferring from about 2–10 lbs/ream (ream size 3,000 $ft^2$) of liquid moisture from the second transfer roll to the opposite surface of the paper web in the second transfer nip so that only the opposite surface of the paper web is moistened; and, (i) calendering the web treated according to step (h) in one or more nips of the machine calender device including the second transfer nip to produce a thin densified layer at the opposite surface of the web while substantially retaining the original bulk of the web.

* * * * *